United States Patent [19]

Ferroli

[11] Patent Number: 4,886,018

[45] Date of Patent: Dec. 12, 1989

[54] BOILER ELEMENT

[75] Inventor: Paolo Ferroli, San Bonifacio, Italy

[73] Assignee: Paolo Ferroli, San Bonifacio VR, Italy

[21] Appl. No.: 270,900

[22] Filed: Nov. 14, 1988

Related U.S. Application Data

[63] Continuation-in-part of Ser. No. 943,115, Dec. 17, 1986, abandoned.

[30] Foreign Application Priority Data

Dec. 23, 1985 [IT] Italy ..... 63409/85[U]

[51] Int. Cl.[4] ..... F22B 23/06; F22B 37/10

[52] U.S. Cl. ..... 122/367 C; 165/185

[58] Field of Search ..... 122/367 C; 165/179, 165/185

[56] References Cited

U.S. PATENT DOCUMENTS 1,993,850 3/1935 McIntire ..... 122/367 C 4,089,302 5/1978 Emsink ..... 122/367 C X

*Primary Examiner*—Edward G. Favors

*Attorney, Agent, or Firm*—Guido Modiano; Albert Josif

[57] ABSTRACT

Boiler element having fins with a biconvex symmetrical or asymmentrical aerodynamic cross section, so as to oppose low resistance to the outflow of the combustion gases.

4 Claims, 2 Drawing Sheets

BOILER ELEMENT

This is a continuation-in-part of Application Serial Number 943,115 filed on Dec. 17, 1986 abandoned.

BACKGROUND OF THE INVENTION

The present invention relates to a boiler element intended to be traversed, in use, at least partly by water to be heated and to form, together with other boiler elements placed alongside it, and coupled with and hydraulically connected to each other, a multi-fuel boiler for heating systems. Between the elements thus assembled, passages are delimited for the combustion or flue gases coming from the combustion chamber, into which passages fins project which are rigid with the boiler elements and arranged to transfer heat from the combustion gases to the water to be heated.

SUMMARY OF THE INVENTION

Another object of the present invention is to provide a boiler element of cast iron, provided with fins and traversed at least partly by water to be heated, which makes it possible to obtain high thermal efficiency owing to the specific configuration and arrangement of the fins, the internal pins and the water deflectors.

According to the invention, the boiler element comprises fins which preferably have a biconvex symmetrical or biconvex asymmetrical aerodynamic cross section so as to offer low resistance to the flow of combustion gases and to be completely, closely surrounded by them, while avoiding the formation of vortices at the rear portion edge of each fin. The fins preferably have a cross section which decreases from their base to the free end. In order to make the best possible use of the heat conveyed by the combustion gases, the fins are arranged in vertically offset rows, and the fins belonging to alternate rows are aligned with each other.

BRIEF DESCRIPTION OF THE DRAWINGS

The invention will become apparent from the following detailed description, given with reference to the accompanying drawings, wherein.

DESCRIPTION OF THE PREFERRED EMBODIMENTS

With reference to the above described Figures, a boiler element 1, is made of cast iron and has an inner cavity 11 to which water to be heated can be fed through a lower inlet nipple 2 and, after being heated, is discharged from it through an upper outlet nipple 3 preferably arranged on the opposite side of the boiler element with respect to the inlet nipple.

Figure 1:
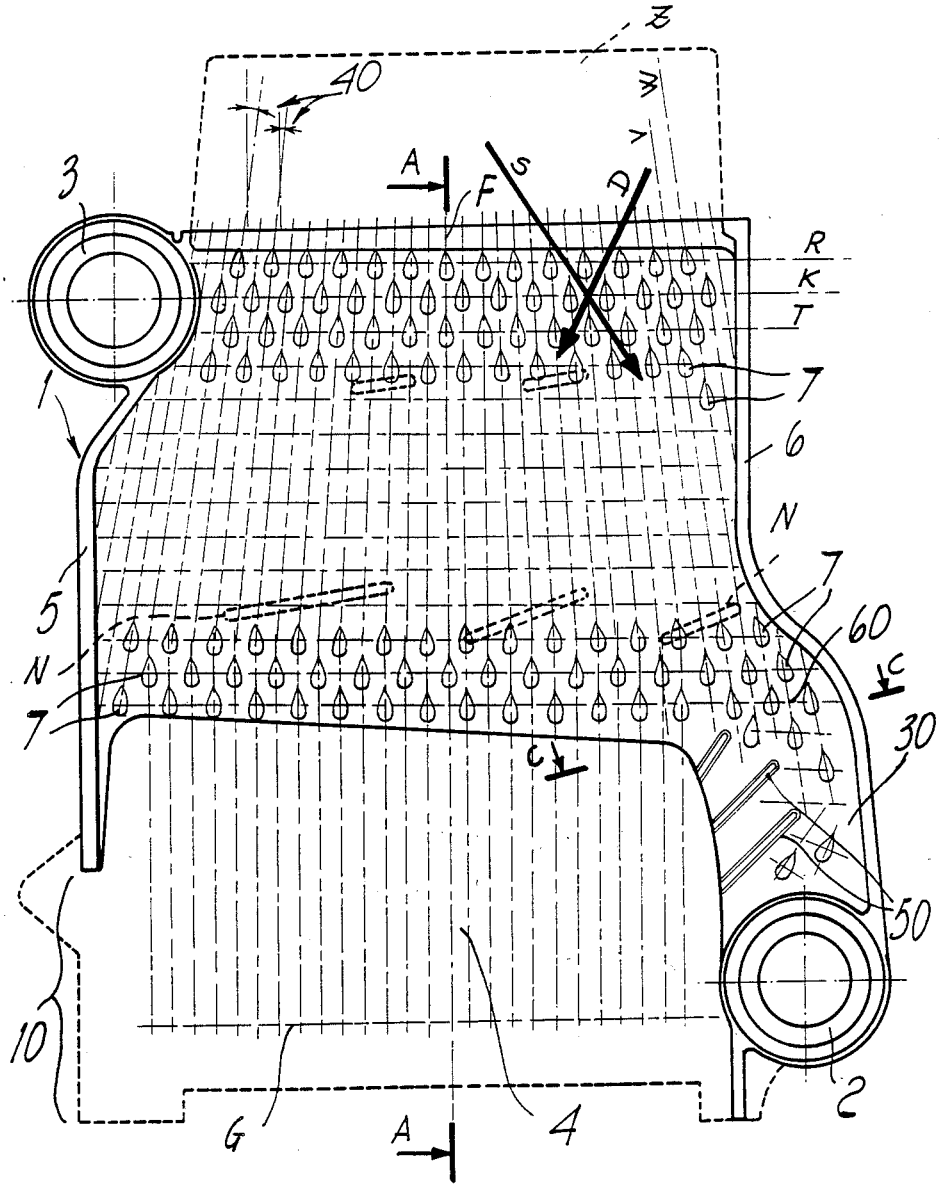
FIG. 1 is a lateral view of a boiler element according to the invention.

A boiler element 1, as that illustrated in full lines in FIG. 1, constitutes an intermediate element of a boiler, i.e. it is designed to be located between two adjacent boiler elements X and Y (FIG. 2) and partly delimit the top and rear side of a lower combustion chamber 4 in the boiler.

Figure 2:
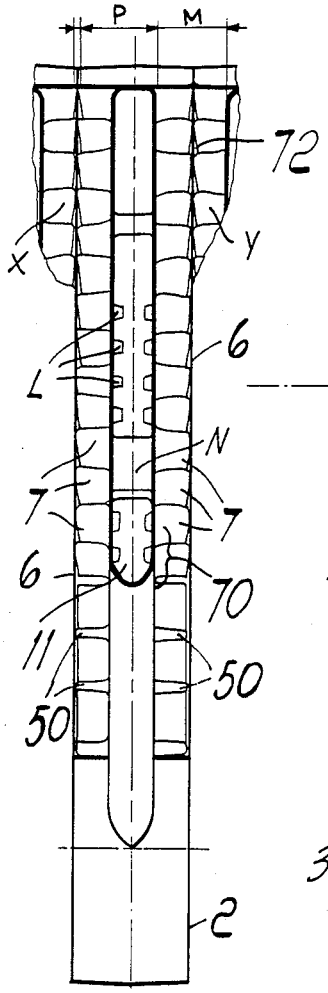
FIG. 2 is a cross-section view taken along the line A—A of FIG. 1.
Figure 3:
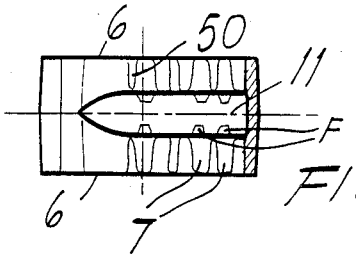
FIG. 3 is a cross-section view along the line C—C of FIG. 1.
Figure 4:
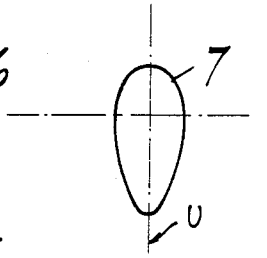
FIGS. 4, 5 and 6 are cross-section views of a respective type of fin, which is asymmetrical and biconvex with respect to its central axis U.
Figure 5:
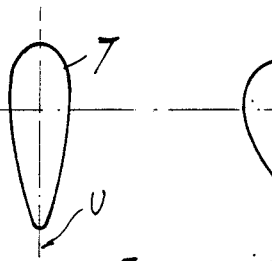
Figure 6:
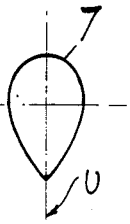

As better shown in FIGS. 1 and 2, each boiler element 1 is substantially flat and has a relatively small thickness, and thus, it has two opposite large faces provided with fins 7, as further described below and a front and rear outer borders provided with peripheral ribs 5 and 6 which act as both abutting edges or spacers and enclosures. In other words the ribs 5 and 6 are arranged, in use, to abut against respective ribs provided on adjacent boiler or elements, and thus they fulfil the function of front and rear confinement for the combustion gases generated in the combustion chamber 4 and moving upwards along passes M provided between the various contiguous boiler elements before entering a top manifold, whose outline is shown by a dotted line and generally indicated with the reference letter Z in FIG. 1.

Figure 9:
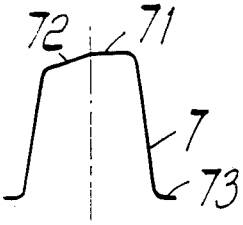
FIG. 9 illustrates two lateral views with respective plan views of the same fin arranged according to two opposite orientations along the same direction.
Figure 9:
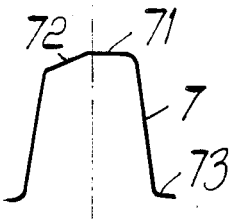
Figure 9:
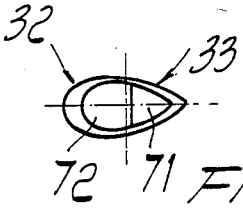
Figure 9:
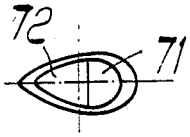

Each intermediate boiler element 1 is provided with a plurality of fins 7 all having the same height and extending from its two opposite faces (FIG. 2) whereas the two lateral boiler elements 1 have fins 7 only on their inner face. Each fin 7 has an aerodynamic shape and preferably has an ovalized or egg-shaped (symmetrical biconvex) or aerofoil-like (asymmetrical biconvex) cross section. The air resistance on the front part 32 (see FIG. 9) is minimal and decreases considerably at the rear portion 33 which is tapered, and thus greatly reduces the detaching area of the flow of the flue gases. The speed at which the combustion gases flow around each fin 7 is higher at the depression region, where the cross section of the fin is smaller, and lower at the pressure region, i.e. in the region where the cross section of the fin is greater. In order to obtain a more effective heat exchange, between the flue gases and the fins 7 the larger cross section of each fin is facing downwards, i.e. against the flue gas flow.

The horizontal component of the resistance for the combustion gases is greater the greater the angle of incidence 40 (FIG. 1).

Beyond a certain value of the angle of incidence, the flue or combustion gas flow starts detaching from the back of the fins and this breakaway phenomenon spreads quickly, as the angle of incidence increases, from the trailing edge towards the leading edge, and results in the formation of whirling regions and in substantial increase in the flow resistance of the combustion gases.

Accordingly, the choice of the type and location (inclination, sense and direction) of the fins 7 will vary according to the function that each fin has in the context of the boiler element.

Moreover, each fin at its top or free end is provided with two top flat surfaces; one 71 parallel and the other 72 slightly inclined with respect to its base 73 integral with the fin.

The peripheral ribs 5 and 6 protrude from one or both faces of a boiler element a distance (height) equal to or slightly greater than the length of the fins 7. Thus, in use, two adjacent boiler elements 1 abut one against the other at their ribs 5 and 6 and define neck-like portions 31 between each pair of facing fins 7.

Figure 11:
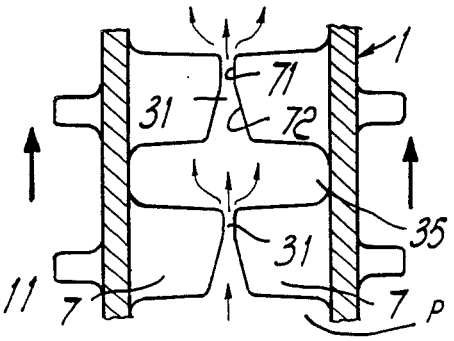
FIG. 11 shows a modification of two adjacent coupled boiler elements of FIG. 10.
Figure 10:
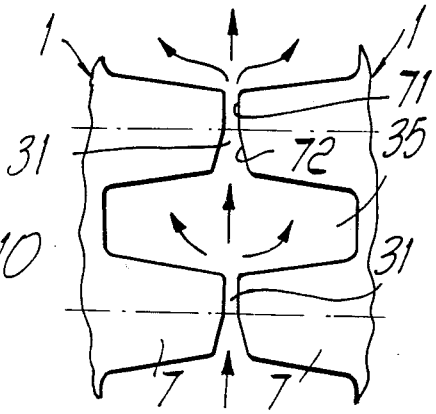
FIG. 10 illustrates combustion gas flowing through the fins of two adjacent coupled elements.
Figure 7:
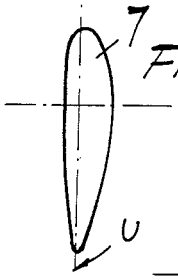
FIGS. 7 and 8 are cross section views of two biconvex fins asymmetrical with respect to their axis U.
Figure 8:
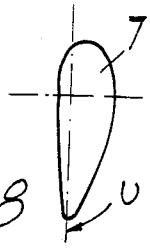

Accordingly, a given portion of the combustion gases is conveyed in sequence first into the neck-like portions 31 (see FIGS. 10 and 11) between a pair of confronting fins 7, and then expands into enlarged zones 35. In this manner the combustion gases, which would otherwise flow undisturbed along in the intermediate region P delimited between two boiler elements 1, are subjected to whirling movements at the fins which considerably assist heat exchange between combustion gases and fins.

Each boiler element 1 has a lower extension or arm 30 which is at least partly hollow and in fluid communication with both the inner cavity 11 and the inlet nipple 2. The arm 30 has at least one elongated transverse rib 50 (three elongated ribs 50 are shown in FIG. 1) which extends from an inner edge of the arm 30 in a transverse upwards direction with respect to the arm and projects outwardly to the same extent as the ribs 7.

The or each elongated rib 50 is preferably U-shaped and arranged to deflect part of the combustion gases from the combustion chamber 4 towards a lateral upper region 60 where further heat exchange occurs due to the presence of fins 7. In order to avoid that in their ascent the combustion gases follow straight paths from the combustion chamber 4 to the manifold Z, the fins 7 of one horizontal row (e.g. K) are arranged offset with respect to those of the contiguous upper and lower row (e.g. R and T), and are also vertically aligned in rows (e.g. V and W), again with the fins 7 in offset arrangement, the vertical rows or lines of fins being upwardly convergent, e.g. towards an intermediate vertical line F, this arrangement allows easy cleaning of the boiler elements 1, since, as can be seen in FIG. 1, the fins form oblique channels (see, e.g. the arrows D and S), along which a cleaning instrument can be easily inserted and moved diagonally up and down. The two lateral boiler elements 1 of the boiler differ from the intermediate elements in that fins are provided only on their inner face, and in that they extend downwards to form a support base, as illustrated by a broken line in the lower part of FIG. 1, and laterally delimit the combustion chamber 4.

Slots for locating tie-rods formed in each boiler element to hold all the boiler elements tightly together. A gas burner G is provided in the lower combustion chamber 4, e.g. approximately at the level of the line G and through a discontinuity 10 provided on the front side of a number of intermediate boiler elements, secondary air can enter the combustion chamber 4. The lower part 70 of each cavity or water chamber 11 in the various boiler elements 1 preferably has an oval or rounded cross section, thereby preventing most of the combustion gases from being deflected towards the tip of the adjacent fins 7, but rather along the lower part thereof, i.e. close to and along the faces of each boiler element.

Deflectors N project inside each water chamber 11 to uniformly distribute the water flow within the cavity 11.

Moreover, small pins L are arranged in each water chamber 11 close to at least one row or fins. Such pins L preferably have a truncated-cone shape with a cross section decreasing from the base towards the tip. Their function is to improve the heat exchange rate between the fins and the water.

I claim:

1. A boiler element of cast iron comprising:

a first and a second opposite faces, said first and second faces having respective outer sides and inner sides, an inner cavity defined by said inner sides of said opposite faces, deflector in said cavity to suitably guide a water flow therein, an extension arm which is at least partially hollow and in fluid communication with said inner cavity, a water inlet in said extension arm, a water outlet located away from said water inlet and in fluid communication with said inner cavity, peripheral ribs protruding from said outer sides of said opposite faces, a plurality of fins protruding from at least one of said outer sides of said opposite faces and extending for a length equal or slightly lesser than said peripheral ribs, said ribs being adapted to sealingly abut against corresponding ribs of at least one adjacent boiler element, each of said fins having a base connected to a respective of said outer side of said face and a free end, said free end being counterposed to a free end of a fin of an adjacent boiler element, said free end having two top flat surfaces, a first of said surfaces extending substantially parallel to said respective face, a second of said surfaces being at an angle with respect to said first surface, said first surface being counterposed to a first surface of said counterposed free end of said fin of said adjacent element, said second surface being counterposed to a second surface of said free end of said fin of said adjacent element, said first surface and said second surfaces respectively defining a neck passage and a widened passage adapted to suitably guide the gases.

2. A boiler element as claimed in claim 1, wherein each fin is tapered towards its free end.

3. A boiler element as claimed in claim 1, wherein pins are provided in said inner cavity which project therein from said inner sides to exchange heat with the water in the cavity.

4. A boiler element as claimed in claim 1, wherein the said extension arm has at least one elongated rib extending from an edge of the arm in a transverse direction to the arm to laterally deflect flue gases.

* * * * *